US006648144B2

(12) United States Patent
Vogel

(10) Patent No.: US 6,648,144 B2
(45) Date of Patent: Nov. 18, 2003

(54) COLLAPSIBLE BALLOT BOX

(75) Inventor: Richard F. Vogel, Wheaton, IL (US)

(73) Assignee: Vogue Election Products & Services, LLC, Glen Ellyn, IL (US)

( * ) Notice: Subject to any disclaimer, the term of this patent is extended or adjusted under 35 U.S.C. 154(b) by 113 days.

(21) Appl. No.: 10/072,093

(22) Filed: Feb. 8, 2002

(65) Prior Publication Data

US 2002/0148889 A1 Oct. 17, 2002

Related U.S. Application Data

(60) Provisional application No. 60/275,375, filed on Mar. 13, 2001.

(51) Int. Cl.[7] ..... G07C 13/02

(52) U.S. Cl. ..... 209/554; 209/655; 232/2; 312/258

(58) Field of Search ..... 209/552, 554, 209/583, 613, 655, 656; 232/2; 220/4.28, 4.32, 6, 7; 235/51, 56, 57, 386; 190/1, 11; 312/205, 240, 258

(56) References Cited

U.S. PATENT DOCUMENTS

| | | | | | |
|---|---|---|---|---|---|
| 306,599 | A | * | 10/1884 | Fagan | 220/6 |
| 1,127,328 | A | * | 2/1915 | Way | 220/7 |
| 1,545,435 | A | | 7/1925 | McFarland | |
| 1,673,769 | A | | 6/1928 | Graham | |
| 4,981,259 | A | | 1/1991 | Ahmann | |
| 5,161,709 | A | * | 11/1992 | Oestreich, Jr. | 220/6 |
| 5,585,612 | A | * | 12/1996 | Harp, Jr. | 235/51 |
| 5,610,383 | A | | 3/1997 | Chumbley | |
| 5,666,765 | A | * | 9/1997 | Sarner et al. | 312/140.2 |
| 6,036,041 | A | | 3/2000 | Chern | |
| 2001/0050306 | A1 | * | 12/2001 | Plumb | 232/2 |

FOREIGN PATENT DOCUMENTS

| | | | | |
|---|---|---|---|---|
| GB | 2 033 875 A | * | 5/1980 | B65D/6/18 |

* cited by examiner

*Primary Examiner*—Donald P. Walsh
*Assistant Examiner*—Joseph Rodriguez
(74) *Attorney, Agent, or Firm*—Cook, Alex, McFarron, Manzo, Cummings & Mehler

(57) ABSTRACT

A collapsible ballot box for collecting ballots from an electronic ballot tabulating machine includes a base assembly, and front and rear support assemblies pivotally attached to the front and rear ends of the base assembly. The three assemblies are foldable into compact and generally parallel-spaced portions for transport and storage. In its storage state, the ballot box is a compact unit with wheels and a handle that can be comfortably transported and/or stored. The ballot box is easily transformed from the storage state to an upright voting state wherein the ballot tabulating machine is positioned at a convenient height for the voter by unfolding the assemblies. In its set-up or voting state, the ballot box receives ballots from the tabulating machine and stores them in one or more secure ballot compartments. An auxiliary ballot compartment can be provided in the front support assembly for receiving unmarked ballots.

45 Claims, 16 Drawing Sheets

COLLAPSIBLE BALLOT BOX

CROSS-REFERENCE TO RELATED APPLICATION

This application claims benefit under 35 U.S.C. §119(e) of U.S. Provisional Application, Ser. No. 60/275,375 filed Mar. 13, 2001, the complete disclosure thereof being incorporated by reference.

BACKGROUND OF THE INVENTION

The present invention relates generally to a ballot box, and more particularly to a collapsible ballot box which may be utilized with electronic ballot scanning devices.

Voting systems—the procedures by which we cast votes and elect our public officials—are a crucial part of the democratic election process. Typically, marked ballot cards are deposited in sealed ballot boxes at the polling location. The sealed ballot boxes are then transported to a central location where the votes are tallied, either by hand counting or by use of an electronic tallying device. Because ballot collection takes place at a location different from the counting location, the possibility of tampering with ballots exists. For example, ballot cards can be removed from the ballot collection box while in transit to the counting location.

Thus, the need for a more secure voting system exists. One such improved system involves the use of an electronic ballot tabulator at the place of voting whose size is roughly close to that of a mechanical adding machine. This tabulator accepts printed ballots that have been marked by the voter, through an inlet slot. Then after tabulating the voter's selections, the machine ejects the ballot card through a discharge slot. In a more elaborate form, the ballot tabulating machine can be provided with one or more additional discharge slots, so that ballots of one category, such as write-in ballots, can be ejected through one slot, and ballots of another category, such as marked ballots, can be ejected through another slot, allowing for separate storage of the two ballot types. It is envisioned that many jurisdictions will promulgate regulations requiring that all tabulated ballots be retained in secure containers. It will, therefore, be necessary to provide ballot boxes capable of collecting the tabulated ballots of different categories directly from the tabulator machine and maintain them in separate and secure chambers.

It will further be necessary that such a ballot box provide a support for the tabulating machine such that the machine is at a convenient height for the voter to insert his ballot. It must be stable enough to support the weight of the machine and a leaning voter. Also, it must provide tamper proof ballot compartments.

It is also necessary that a ballot box be compact for convenience of transport and storage. Moreover, it must be economical to manufacture.

In view of the aforementioned needs and the shortcomings of the prior art, it is, therefore, a general object of the present invention to provide a ballot box for use with an electronic ballot tabulator which will receive tabulated ballots directly from the ballot tabulating machine and retain the ballots in separate, secure compartments.

It is another object of the present invention to provide a ballot box that is collapsible for storage and transport.

It is yet another object of the present invention to provide a ballot box which has a separate auxiliary compartment that can receive ballots temporarily, if, for some reason, the ballot tabulating machine becomes inoperative.

Still another object of the present invention is to provide a ballot box which is secure of tampering and fraud during the voting, counting and/or transporting of ballot cards.

These and other objects, features and advantages of the present invention will be clearly understood through a consideration of the following detailed description.

SUMMARY OF THE INVENTION

According to the present invention, there is provided a collapsible ballot box having a base assembly with a top surface including a slot for receiving a ballot. Front and rear support assemblies are pivotally attached to the base assembly. The rear support assembly further forms a compartment for receiving ballots. The support assemblies are positionable to positions generally parallel to the base assembly to form a compact unit for storage.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIGS. 9A and 9B through 11A and 11B are top and side views, respectively, partially in section, of the collapsible ballot box of the invention depicting the relationship of the principal elements of the ballot compartments during set up.

FIGS. 12A–2E are front perspective views of the base assembly of the collapsible ballot box of the invention depicting the installation of an electronic voting device on the ballot box.

DESCRIPTION OF THE PREFERRED EMBODIMENT

Figure 1:
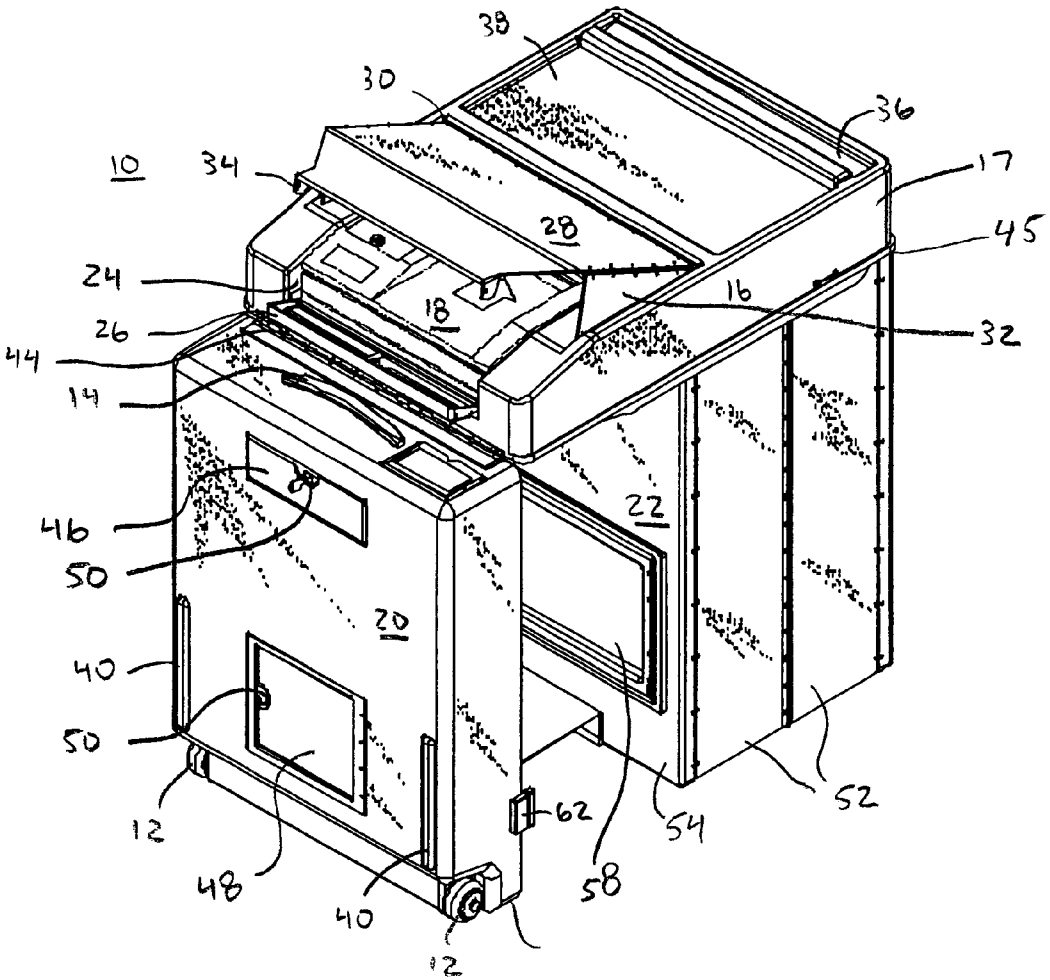
FIG. 1 is a perspective view of a collapsible ballot box constructed in accordance with the principles of the present invention in an assembled upright state for voting.
Figure 2:
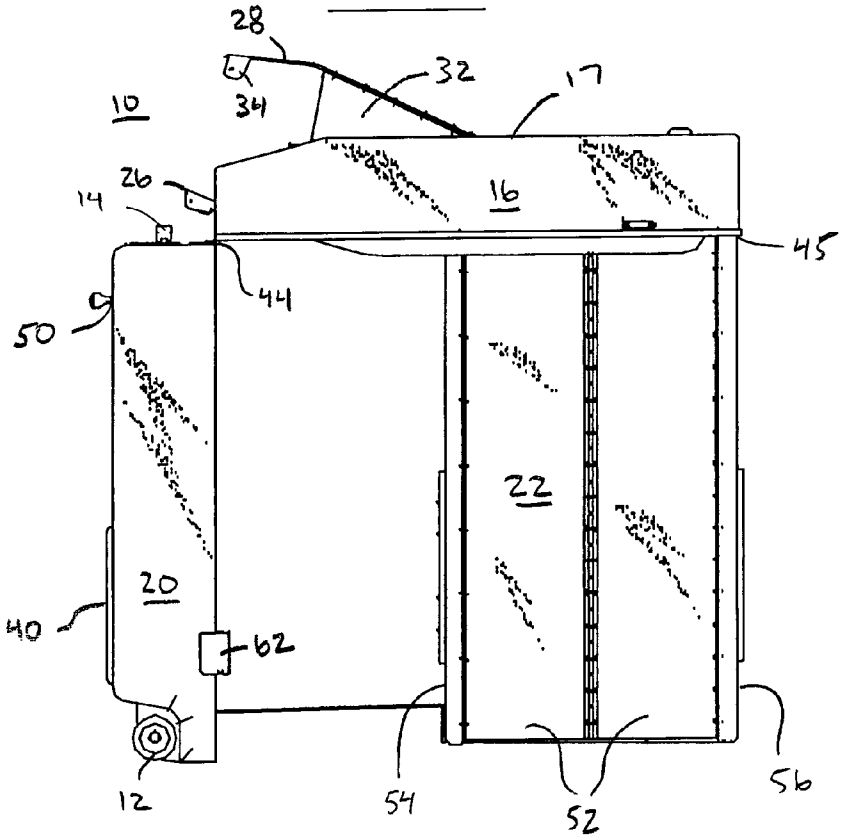
FIG. 2 is a side elevational view of the collapsible ballot box of FIG. 1.
Figure 3:
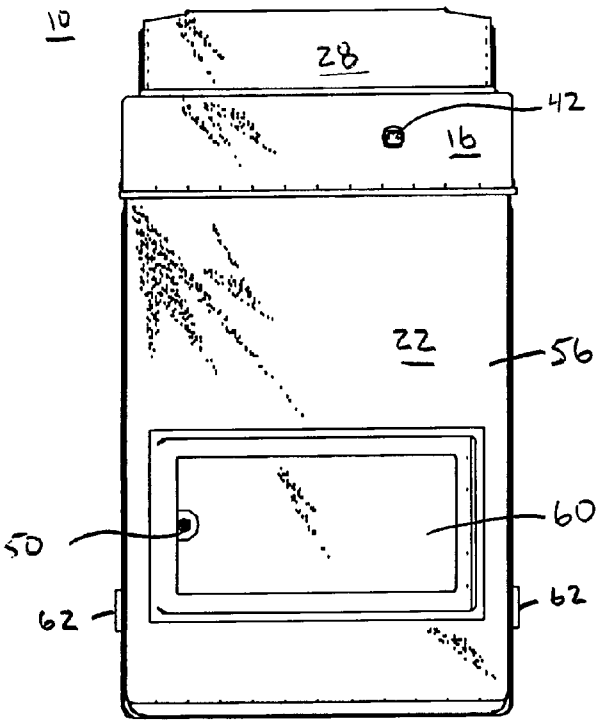
FIG. 3 is a rear elevational view of the collapsible ballot box of FIG. 1.

Referring to the Figures, and particularly to FIGS. 1–3, a collapsible ballot box 10 constructed in accordance with the principles of one embodiment of the present invention is shown set-up in its operable or voting state. In this preferred embodiment, the ballot box consists of three major components capable of folding or collapsing into a suitcase-like unit with wheels 12 and a handle 14. These three components include an elongated base assembly 16 for housing and locking a ballot tabulating machine 18, a front support assembly 20 and a rear support assembly 22.

The top assembly 16 includes a receptacle or recess 24 for receiving an electronic vote tabulating device 18 and a lockable retaining member 26 for preventing removal of the device. Power and/or communication means (modem, cable, etc.) Can be supplied to voting device 18 via a tube 42. A cover or shield 28 is pivotably attached to the housing 17 of base assembly 16 via piano-style hinges 30 or the like. Shield 28 serves a number of purposes. First, as a privacy shield by maintaining the voter's selections private as he or she feeds a marked ballot into ballot tally machine 18. The shield 28 also acts as an equipment transport shield, preventing tampering with or removal of the vote tabulating machine 18. For example, after set-up and during the election process, if the collapsible ballot box 10 is to be left unattended, the wings 32 of the shield can be folded inward and the locking tabs 34 utilized to secure the shield over the vote tabulator in conjunction with the pins of locking mechanism 26. This lock-down status is also useful during transport as it serves to protect the ballot tabulator 18. The base assembly 16 further includes a wheel recess 36 and a rib recess 38 to support and stabilize, via wheels 12 and ribs 40 respectively, the stacking of multiple units 10 during storage.

The front support assembly is preferably secured to the top housing 16 by a piano-type hinge 44 running the width of both assemblies. This front support assembly 20 also serves a number of functions. First, the wheels 12 and handle 14 enable the unit 10 to be rolled about in its voting and transport states. The front support assembly 20 is also an auxiliary storage container for ballots not processed by the ballot tally machine 18 if, for some reason, the machine 18 is inoperable or not available. In this event, the top slot access door 46 enables ballots to be deposited, while the bottom access door 48 allows ballots to be removed from the compartment for counting. Both doors 46 and 48 preferably include locking assemblies 50 to prevent tampering.

Like the front support assembly 20, the rear support assembly 22 is preferably secured to the top housing 16 by a piano-type hinge 45 running the width of the assemblies. The rear support assembly 22 includes accordion-hinged side panels 52 which fold inward and the front panel 54 folds toward the back panel 56 to form a compact storage and transport unit. The ballot assembly has a folding divider panel that divides the assembly into, preferably, two compartments. One compartment can be used, for example, for marked ballots, while the other compartment can be used for write-in ballots. An access door 58 on the front panel 54 and an access door 60 on the back panel 56 of the rear support assembly provide access to each individual compartment. Like the front support assembly 20, locking assemblies 50 are included on each door for security.

Figure 5:
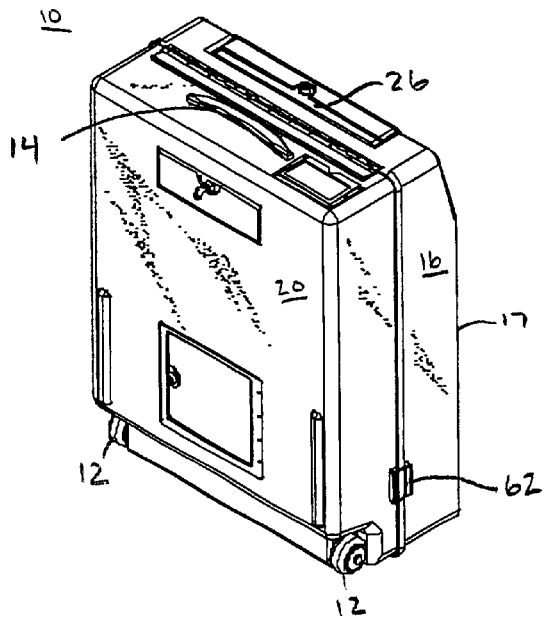
FIG. 5 is a bottom perspective view of the collapsible ballot box of FIG. 4.
Figure 4:
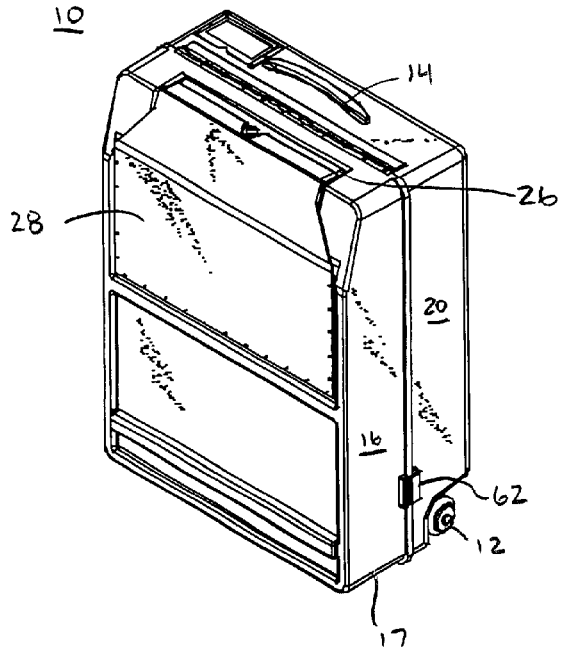
FIG. 4 is a top perspective view of collapsible ballot box of the invention in a storage or transport state.

Referring now to FIGS. 4 and 5, the collapsible ballot box unit 10 is shown in its collapsed transport or storage state. Here, the rear support assembly 22 is fully nested within the housing 17 of base assembly 16. Side latches 62 lock the base assembly and front support assembly together for easy transport via handle 14 and wheels 12. As previously discussed, the shield 28 is in its closed and locked-down position within locking assembly 26.

Figure 6A:
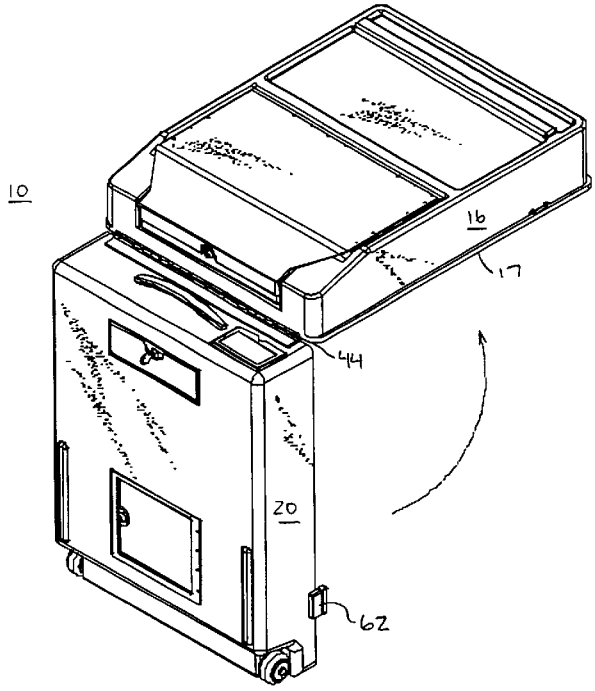
FIGS. 6A–6F are frontal perspective views of the ballot box of FIGS. 1–5 showing the steps involved in setting up the ballot box from a transportable or storage state to its voting state.
Figure 6B:
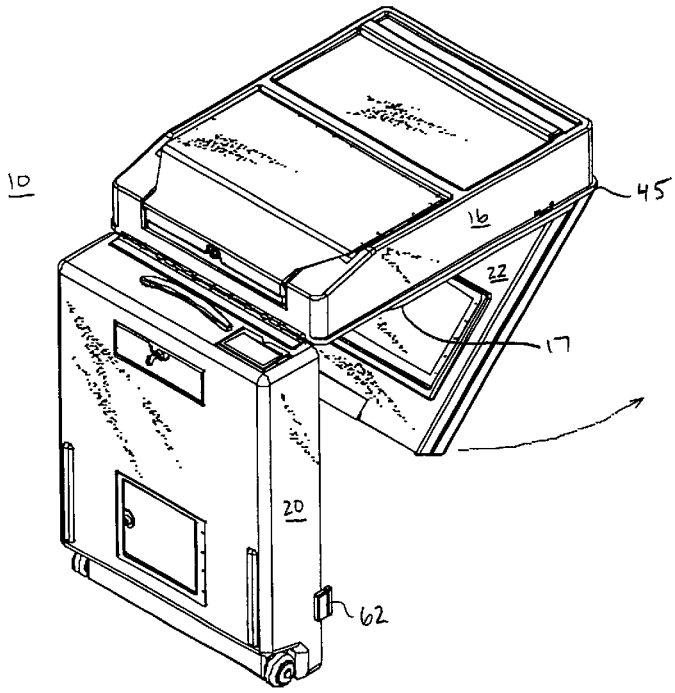
Figure 6C:
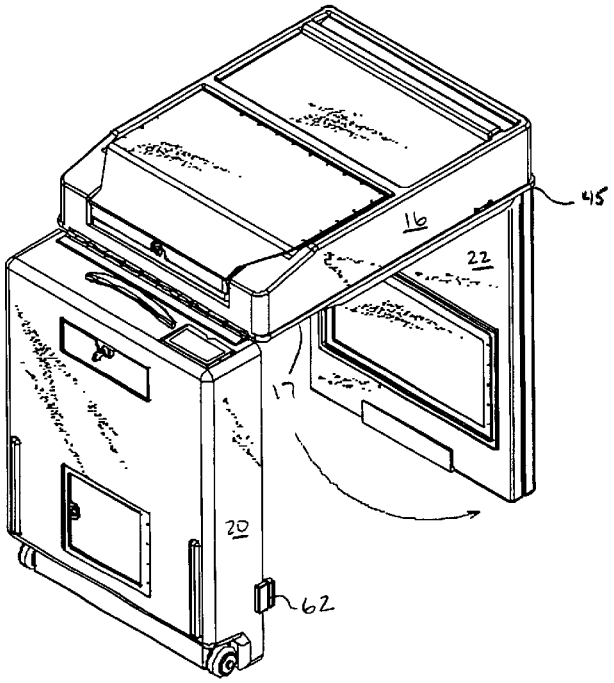
Figure 6D:
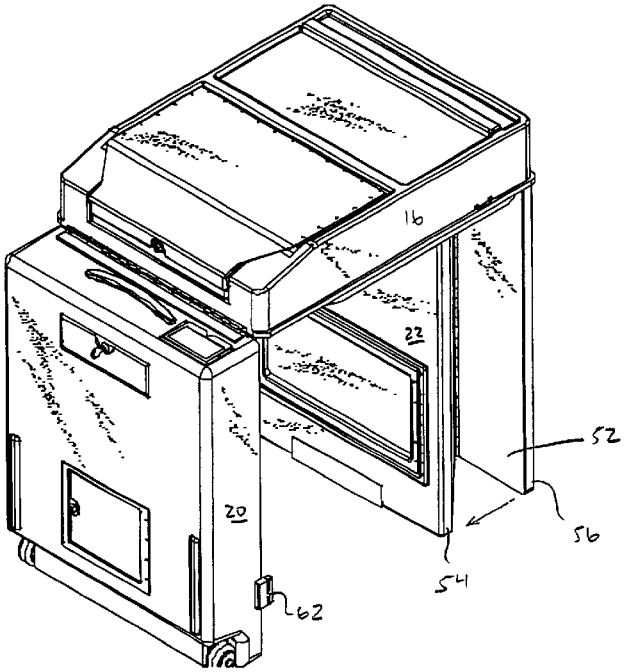
Figure 6E:
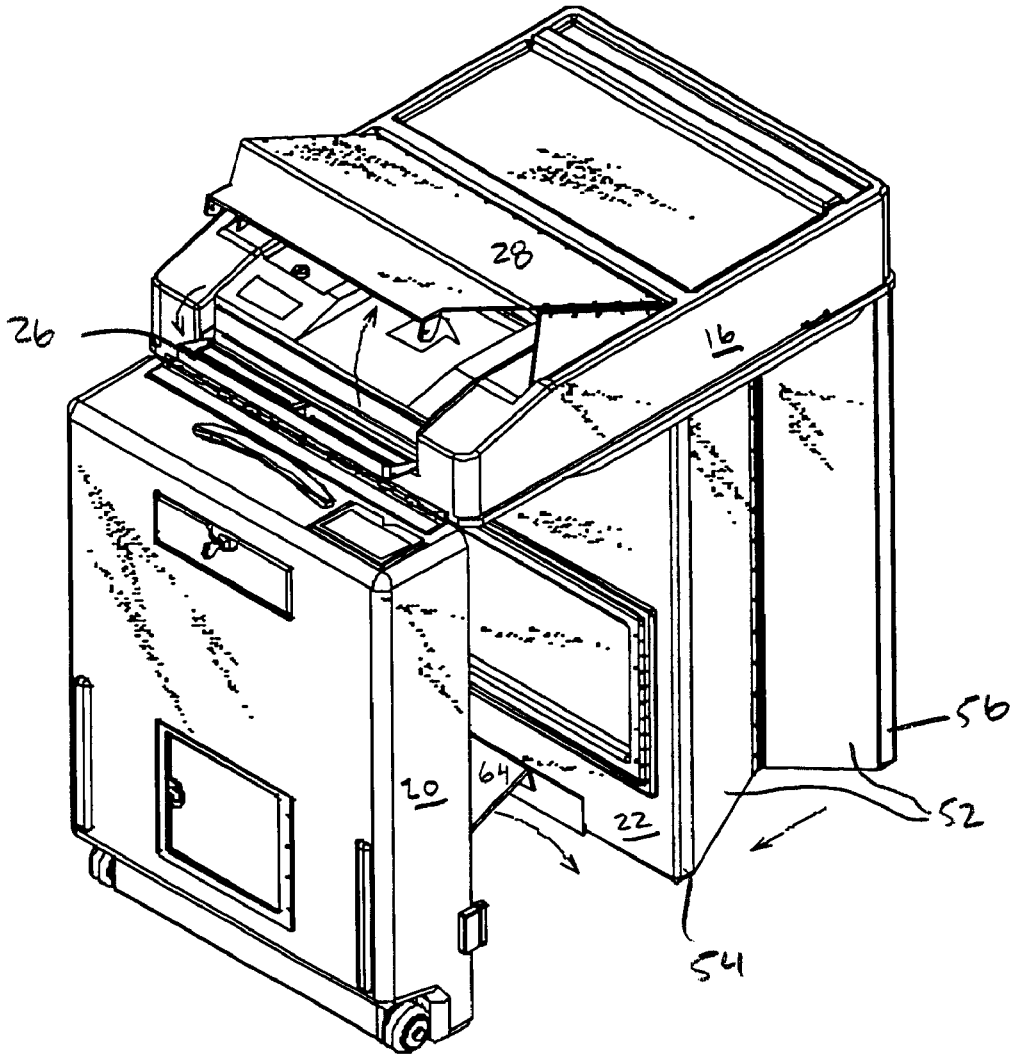
Figure 6F:
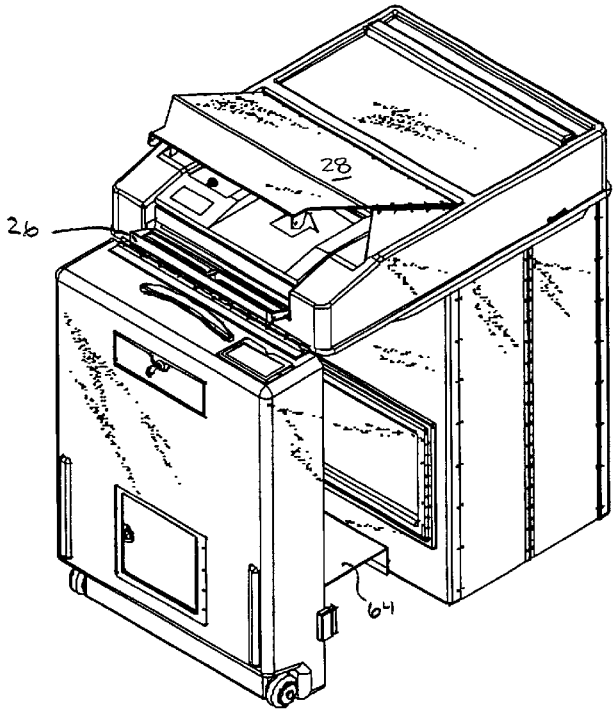
Figure 6G:
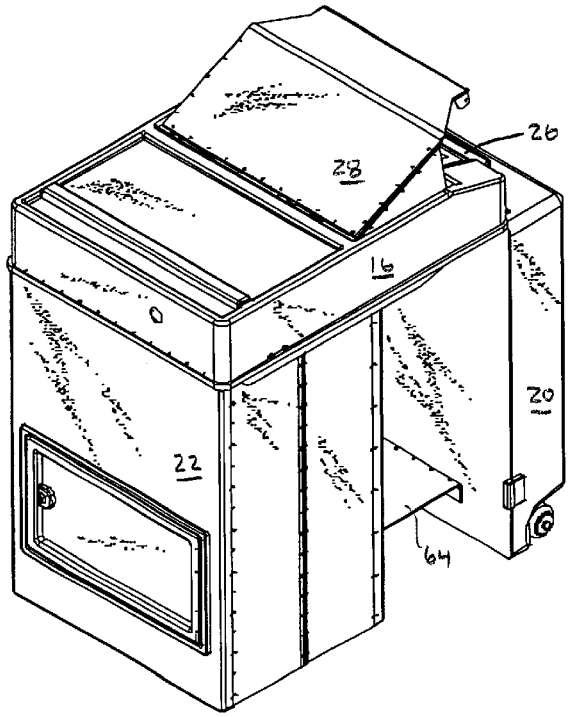
FIG. 6G is a rear perspective view of the ballot box of FIG. 6F.

The principal steps of the set-up procedure from the transport or storage state to the operably or voting state of ballot box 10 illustrated in FIGS. 6A–6G. After unit 10 is rolled to the desired set up area, it is positioned upright as shown in FIG. 5. After the side latches 62 are unlatched, unit 10 is laid on its side and opened to approximately a 90° angle by extending the top housing 17 away from the front support assembly 20 via hinge 44, as shown in FIG. 6A. FIGS. 6B and 6C illustrate the swinging of the rear support assembly 22 out of the top housing 17 via hinge 44 until opened to approximately a 90° angle. Now, the rear support assembly 22 is unfolded by extending the front panel 54 away from the rear panel 56. During this extension, as shown in FIGS. 6D and 6E, the side panels 52 will unfold outward from their collapsed state. Also, as shown in FIG. 6E, the compartment attachment plate 64 is folded into place from the front support assembly 20 and attached to the rear support assembly 22, and the shield 28 is lifted from its lockdown transport state within the locking member 26 to an open position for voting. The attachment plate or support assembly can be pivotally attached to either one of the front or rear support assemblies and detachably attached to the other. FIGS. 6F and 6G show front and rear perspective views of the ballot box set-up in an operable or voting position above an underlying support surface.

Figure 7:
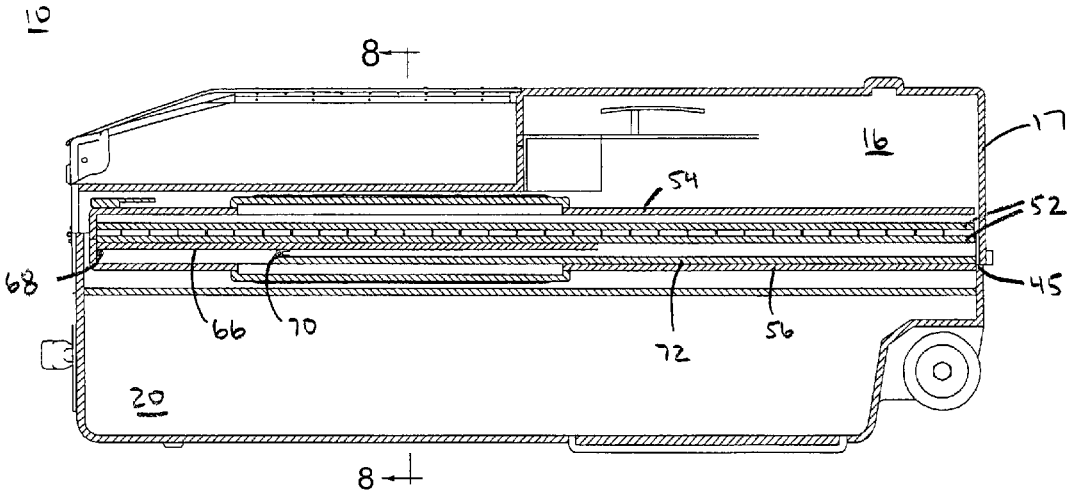
FIG. 7 is a partial cross-sectional side view of the collapsible ballot box of FIGS. 1–6 in a storage or transport state.
Figure 8:
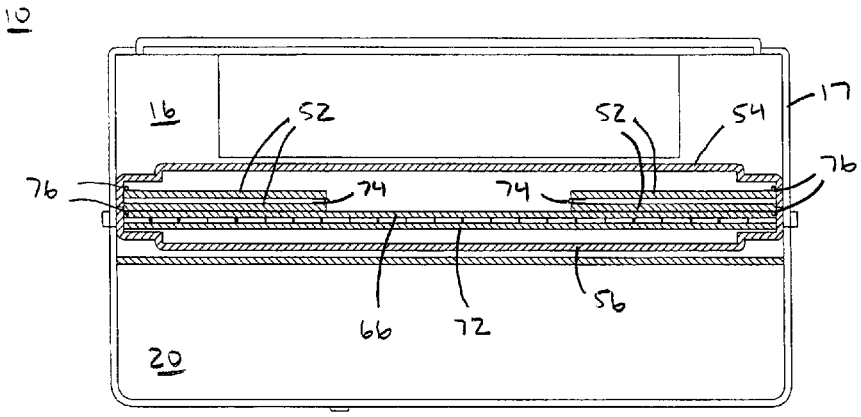
FIG. 8 is a semi-cross-sectional view of the collapsible ballot box of FIG. 7 taken along lines 8—8.

The inner compartment elements of the rear support assembly 22 of the present embodiment are described in FIGS. 7–11. Referring first to FIGS. 7 and 8, the collapsible ballot box 10 is shown in cross-section in its collapsed state. As such, the internal dimensions of the principal components of the rear support assembly 22 are more clearly illustrated. The back panel 56 of the assembly 22 is hinged to top housing 17 at hinge 45. Thus, there is interior space within top housing 17 for receiving the assembly 22. What will become the floor 66 of the ballot compartment of assembly 22 is pivotably attached to rear panel 56 at pivot 68. Pivotably attached to the floor 66 at pivot 70 is what will become the ballot compartment divider 72. What will become the side panels 52 of the assembly 22 are pivotably attached to their respective sides at pivot 74 and pivotably attached to the front 54 and rear 56 panels at pivot 76.

Figure 9B:
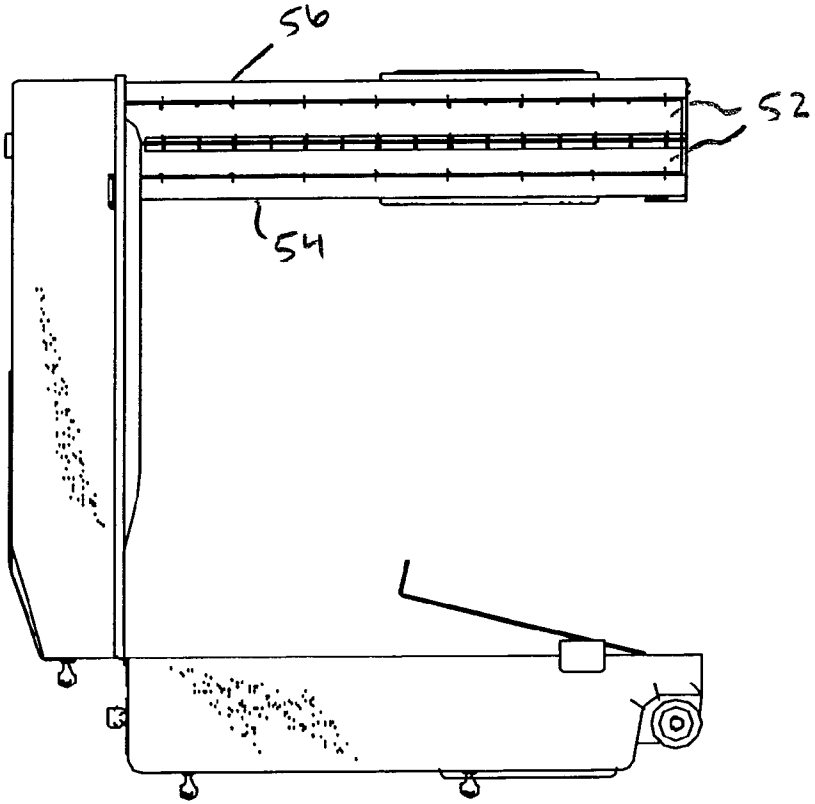
Figure 9A:
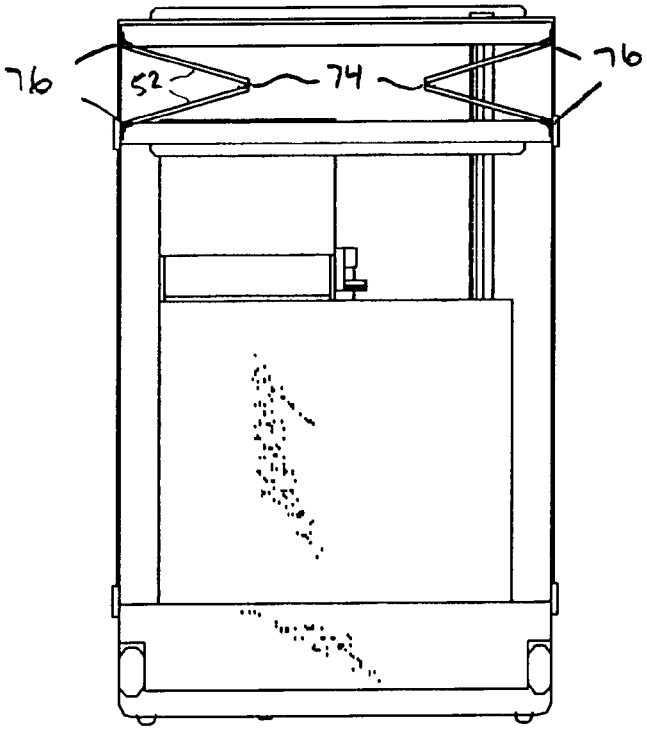
Figure 10B:
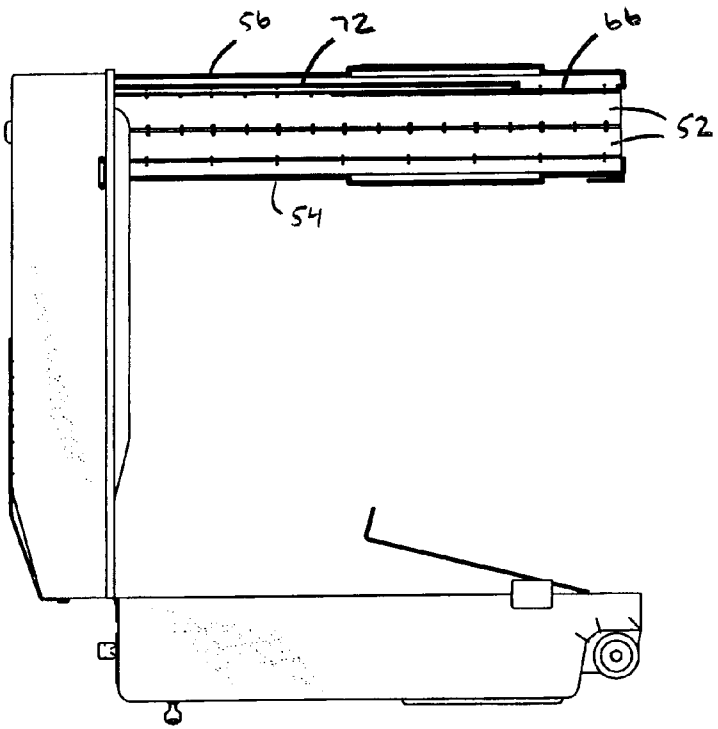
Figure 10A:
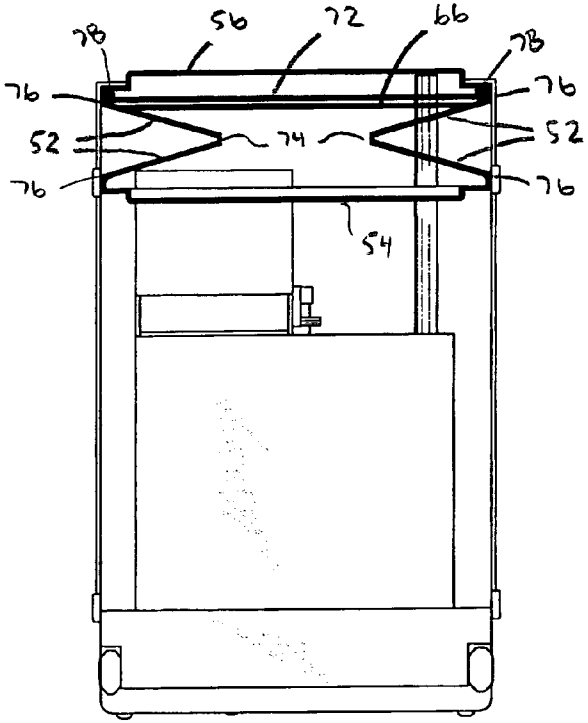
Figure 11B:
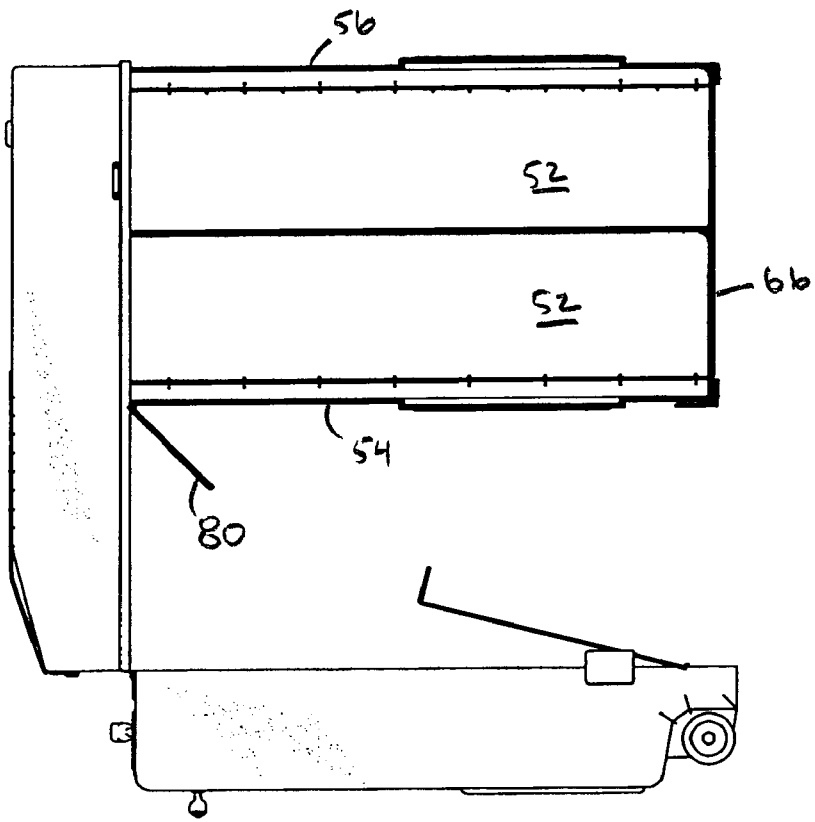
Figure 11A:
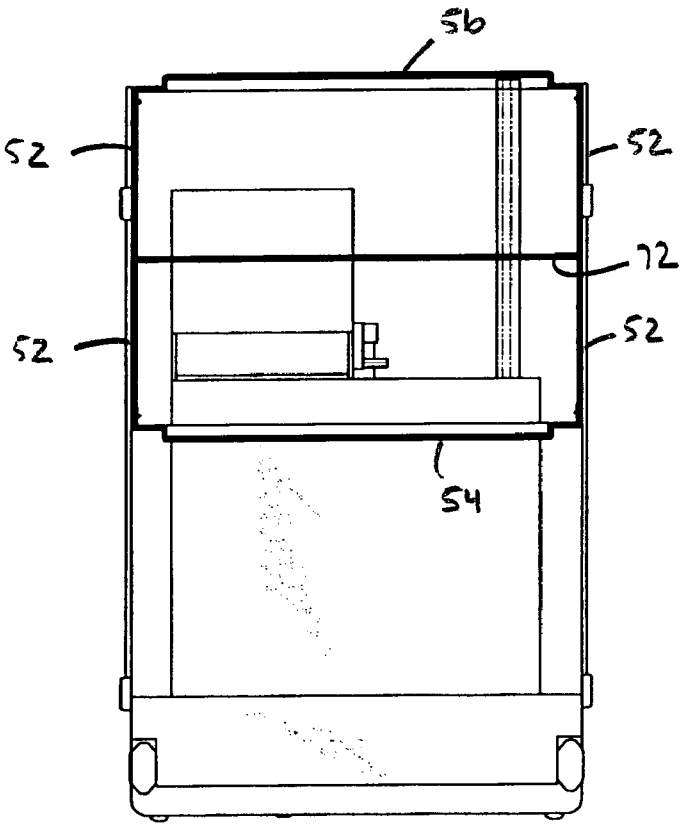

Referring now to FIGS. 9–11, the unfolding of the rear support assembly 22 is now shown through the semi-cross-sectional top and side views of these figures. FIGS. 9A, 10A and 11A illustrate the top view while FIGS. 9B, 10B and 11B illustrate the corresponding side view. These figures show the progression of the panels, floor and divider as the front panel 54 is extended away from the rear panel 56. Note the attachment of the divider 72 with the rear panel 56 at 78 in FIG. 10A. The preferred securement means is a pivotably attached elongated rigid member (78) that enables the divider 72 to settle at a perpendicular position with the floor 66 when the assembly 22 is in the operable state, thereby acting as a divider wall for the ballot compartments. It will be understood that the ballot assembly must inherently include means to prevent access to the internal compartments unless entered through the doors. In the preferred embodiment, all of the movable panels are locked in place when set-up is complete. Such locks are discussed herein (supra) with respect to the locking assembly 26, but may also include a number of locking members or guards 80 (FIG. 11B).

Figure 12A:
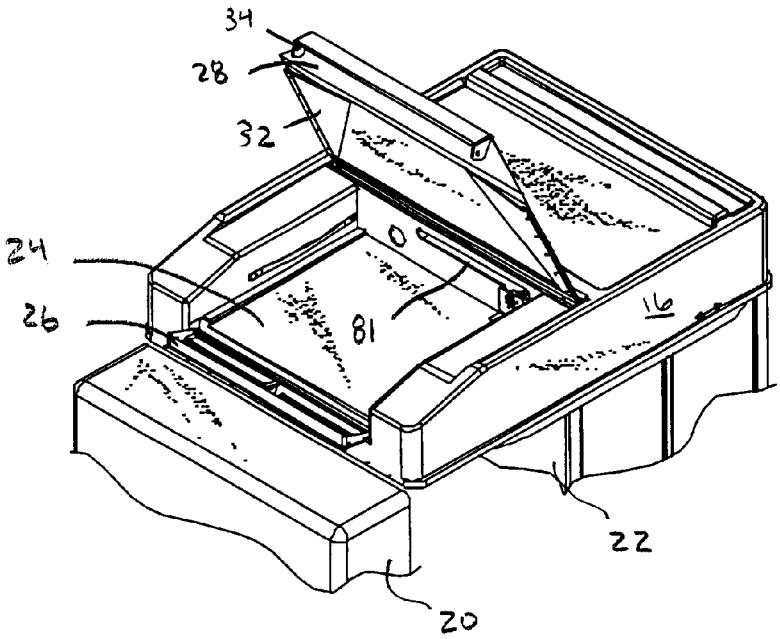
Figure 12B:
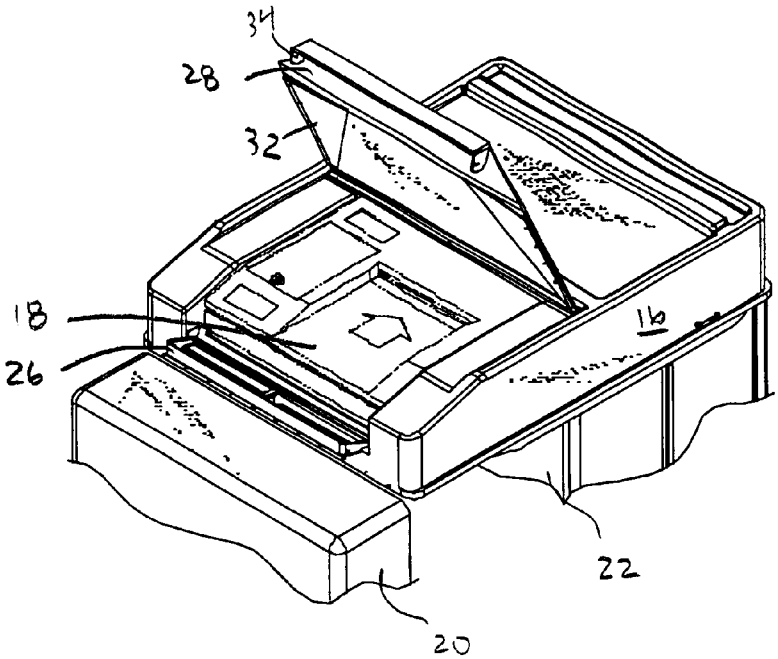
Figure 12C:
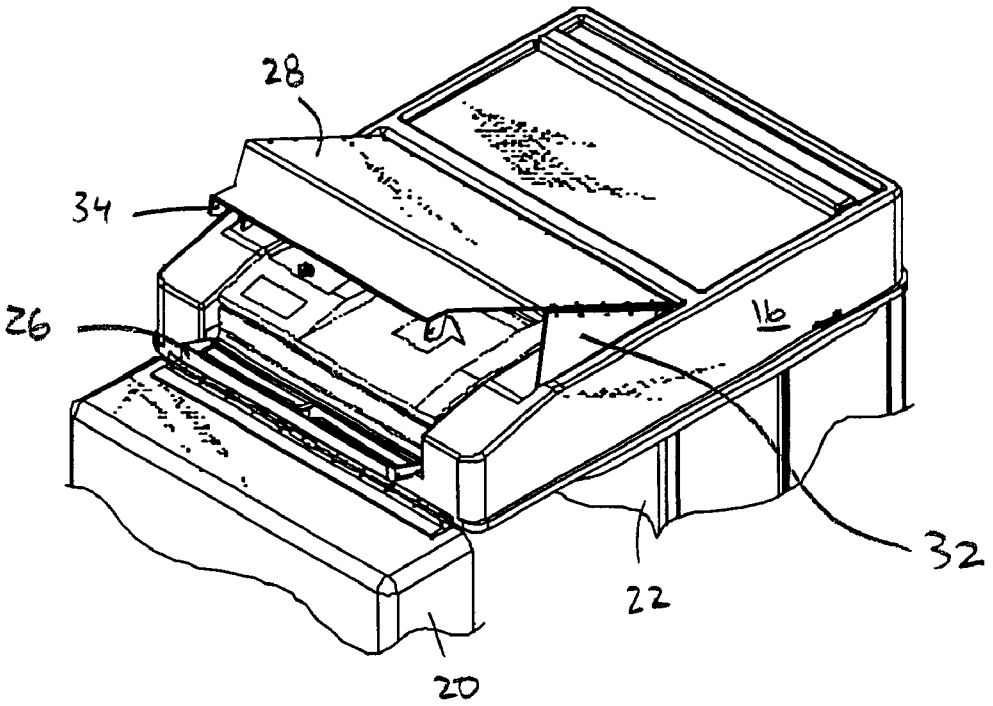
Figure 12D:
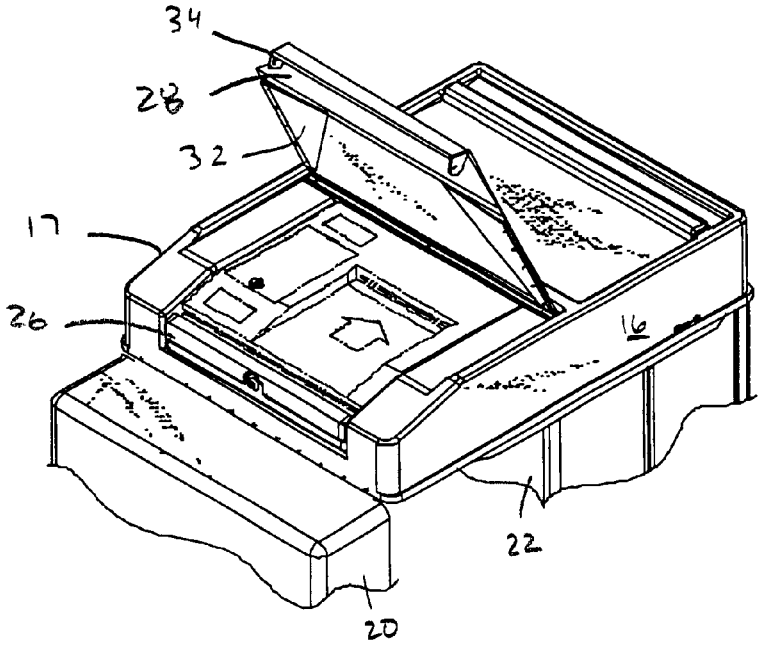
Figure 12E:
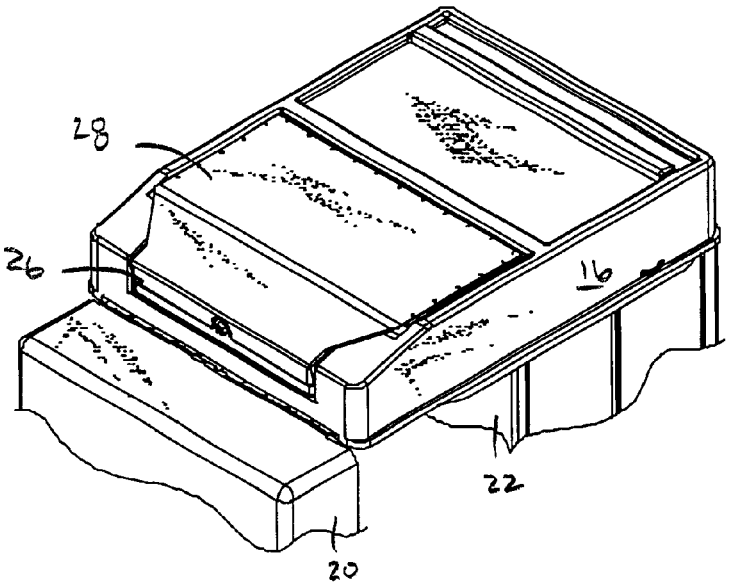

The base assembly 16 of the preferred embodiment will now be described in FIGS. 12A–E as it relates to the electronic ballot tabulating machine 18 to be used in conjunction with the present invention. FIG. 12A shows the shield 28 raised to provide access to the recess 24, connection means 42 and the slot in the base assembly 16 by which ballots are fed from the ballot tabulating machine 18 through to the respective subcompartments of the rear support assembly 22. FIG. 12B shows the electronic tabulating device 18 fitted within the recess 24 of the base assembly 16. The locking assembly 26 then locks the device 18 within the recess of top housing 17 (FIG. 12D). The wings 32 of shield 28 can be exposed and rested on the housing (FIG. 12C), or the wings 32 can be folded into the shield 28 and the ballot tabulating device 18 will be locked thereunder when the locking tabs 34 receive the locking pins of locking assembly 26 (FIG. 12E).

Figure 13A:
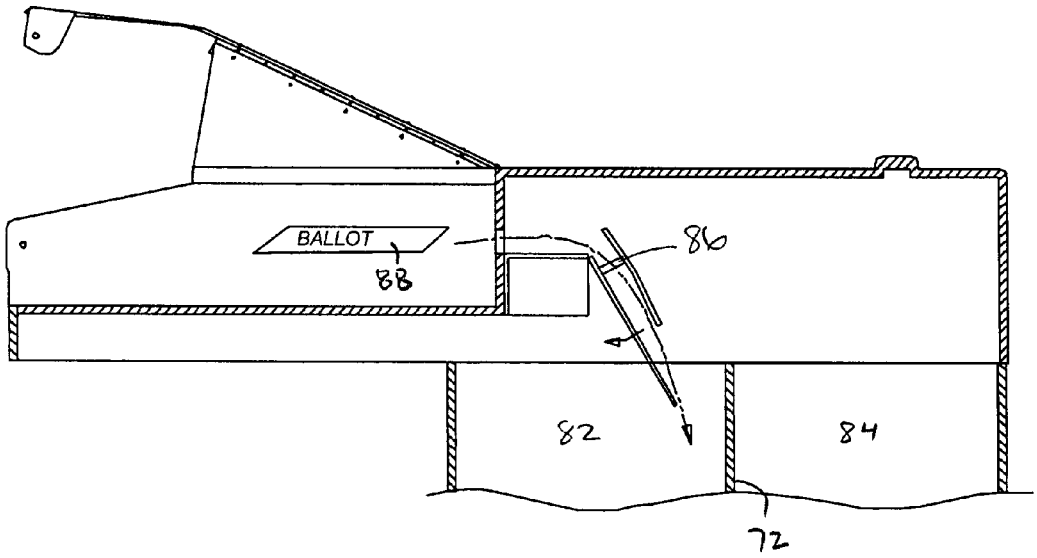
FIGS. 13A and 13B are side cross-sectional views illustrating the routing of the tabulated ballots discharged from the ballot tallying machine into appropriate ballot compartments in the collapsible ballot box of the invention.
Figure 13B:
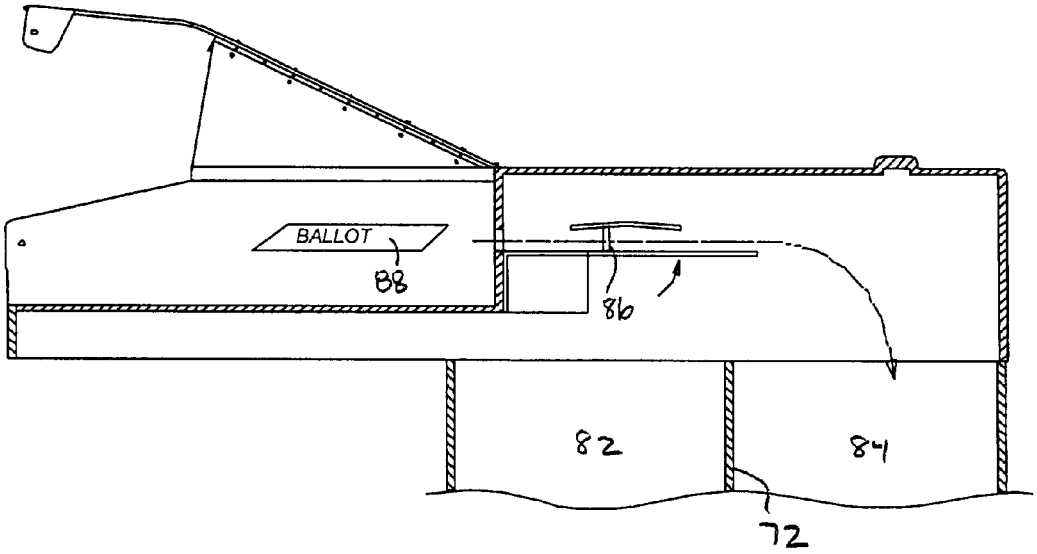

The present invention can incorporate a ballot sorting device or a ballot deflector device in communication with the ballot tabulating device 18. Such a deflector is shown in FIGS. 13A and 13B. As previously discussed, the rear support assembly 22 can be divided via divider 72 into two subcompartments, a front subcompartment 82 and a rear subcompartment 84. The deflector 86, in response to the ballot tabulating device's determination, for example, of a voted ballot or a write-in ballot (i.e. control effect), will route the ballot 88 into the respective compartment.

Figure 14:
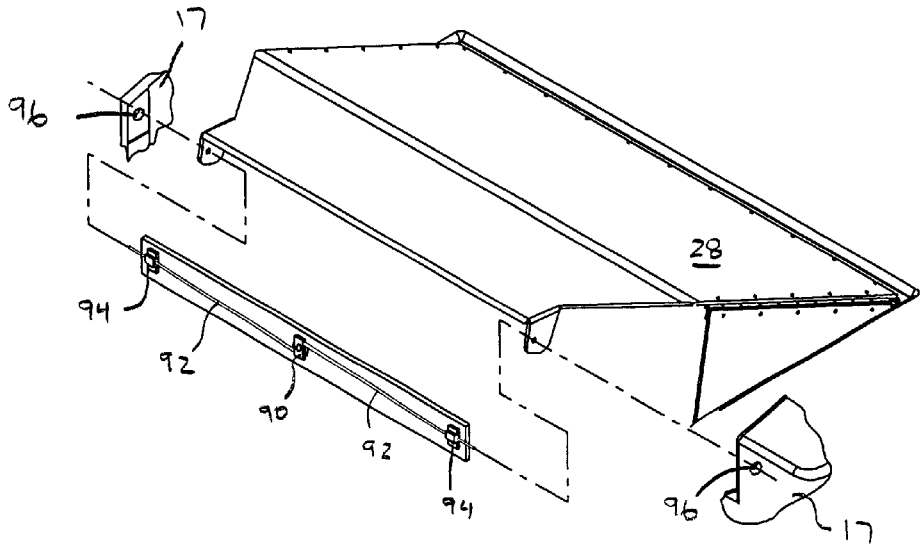
FIG. 14 is a perspective view of the locking mechanism for the retaining member and top cover of the ballot box.

The locking assembly 26 of the preferred embodiment is more specifically described in FIG. 14. The actuator thereof consists of a keylock 90 connected to locking pins 92. These locking pins 92 are positioned via brackets 94 to extend through a hole 96 in the base housing 17. This locking assembly 26 can, therefore, secure the unit 10 for transport/storage by locking down the shield 28, and/or can secure the unit 10 during use by locking in the ballot tabulating device 18.

Figure 15A:
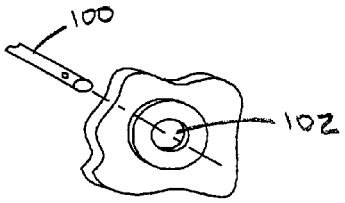
FIGS. 15A and 15B are perspective views of a preferred rod and seal security assembly utilized by the collapsible ballot box of the present invention.
Figure 15B:
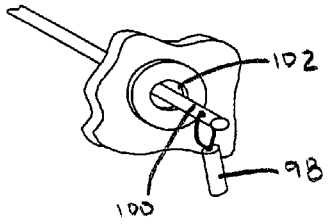

For additional security, the locking assembly 26, as well as the integral parts of the rear support assembly 22, can utilize the pin and seal locking components shown in FIG. 15. With respect to the locking assembly 26, the locking pins 92 thereof pass through holes 96 in housing 17 and can be clasped with a one-time wire seal 98. Similarly, the panels of the rear support assembly 22 may similarly utilize pins 100 in communication with holes 102 and can be sealed by similar onetime wire seals 98.

The ballot box of the invention can be economically manufactured from a high-impact thermo plastic using conventional molding techniques. It will be appreciated that the ballot box can, in an alternate embodiment, be designed with a single ballot container in the rear support assembly, and that the auxiliary ballot compartment in the front support assembly can be omitted if not required.

While a particular embodiment of the invention has been shown and described, it will be obvious to those skilled in the art that changes and modifications may be made therein without departing from the invention in its broader aspects and, therefore, the aim in the appended claims is to cover all such changes and modifications as fall within the true spirit and scope of the invention.

What is claimed is:

1. A collapsible ballot box comprising:

an elongated base assembly having a front end, a rear end, first and second side panels and a top surface, said top surface including a slot for receiving marked ballots;

an elongated front support assembly having a top end, a bottom end and a front wall;

an elongated rear support assembly having a top end, a bottom end, a front wall, a rear wall, first and second side walls, and a bottom wall, said walls forming a compartment for receiving marked ballots;

said top end of said front support assembly being pivotally attached to said front end of said base assembly;

said top end of said rear support assembly being pivotally attached to said rear end of said base assembly; and said front and rear support assemblies being pivotally positionable generally perpendicularly to said base assembly and being of a suitable length whereby said base assembly is supported in a generally horizontal voting position above an underlying support surface with said ballot receiving compartment positioned to receive marked ballots passing through said slot, said front and rear support assemblies being further pivotally positionable to positions generally parallel to said base assembly to form a compact unit for storage.

2. A collapsible ballot box as defined in claim 1 wherein said top surface of said base assembly includes a receptacle for receiving a ballot tally machine, said slot being positioned in said top surface to receive ballots processed by said machine.

3. A collapsible ballot box as defined in claim 2 wherein said base assembly includes a lockable retaining member for preventing removal of said ballot tally machine from said receptacle.

4. A collapsible ballot box as defined in claim 3 wherein said base assembly further includes a pivotally attached cover positionable to prevent access to said ballot tally machine, said cover in its closed position being engaged by and locked closed by said lockable retaining member.

5. A collapsible ballot box as defined in claim 2 wherein said ballot compartment includes a divider wall forming first and second subcompartments within said ballot compartment, and said base assembly includes a ballot sorting device for selectively directing ballots passing through said slot to either said first or second subcompartments.

6. A collapsible ballot box as defined in claim 5 wherein said top surface includes a receptacle for receiving a ballot tally machine, said slot is positioned on said top surface to accept ballots processed by said machine, and said ballot sorting device is responsive to a control effect developed by said ballot tally machine.

7. A collapsible ballot box as defined in claim 5 wherein said front and rear walls of said rear support assembly each include a lockable access door for removing ballots from respective ones of said ballot subcompartments.

8. A collapsible ballot box as defined in claim 1 wherein said sidewalls of said rear support assembly each comprise two sections, said sections being pivotally attached to each other and to the adjacent front and rear walls of said rear support assembly, and being dimensioned to fold inwardly between said walls to collapse said ballot compartment for storage.

9. A collapsible ballot box as defined in claim 8 wherein said bottom wall is pivotally attached to the bottom end of either said front wall or said rear wall of said rear support assembly and is dimensioned to close the bottom end of said ballot compartment.

10. A collapsible ballot box as defined in claim 1 wherein said front support assembly includes a rear wall, first and second side walls and a bottom wall forming in conjunction with said front wall of said front support assembly an auxiliary ballot compartment for receiving ballots not processed by said ballot tally machine.

11. A collapsible ballot box as defined in claim 10 wherein said front wall of said front support assembly includes a slot for depositioning ballots in said auxiliary ballot compartment.

12. A collapsible ballot box as defined in claim 11 wherein said front wall of said front support assembly includes a lockable cover for closing said slot.

13. A collapsible ballot box as defined in claim 12 wherein said front wall of said front support assembly includes a lockable access door for removing ballots from said auxiliary ballot compartment.

14. A collapsible ballot box as defined in claim 1 wherein said rear wall of said rear support assembly includes a lockable access door for removing ballots from said ballot compartment.

15. A collapsible ballot box as defined in claim 1 including a locking member for locking said rear support assembly in said generally perpendicular balloting position.

16. A collapsible ballot box as defined in claim 1 wherein said base assembly includes an interior compartment for receiving at least a portion of said rear support assembly in said collapsed position for storage.

17. A collapsible ballot box as defined in claim 16 wherein generally said entire rear support assembly is received within said base assembly for storage.

18. A collapsible ballot box as defined in claim 17 including means for fastening said front support assembly to said sidewalls of said base assembly to form a single compact unit for storage.

19. A collapsible ballot box as defined in claim 1 including a support member attached at one end of the bottom end of said front support assembly, and at the other end to the bottom end of said rear support assembly, one of said ends being pivotally attached and the other of said ends being detachable.

20. A collapsible ballot box comprising:

an elongated base assembly having a front end, a rear end, first and second side panels and a top surface, said top surface including a receptacle for receiving a ballot tally machine, and a slot for receiving marked ballots, said slot being positioned to receive ballots processed by said machine;

an elongated front support assembly having a top end, a bottom end and a front wall;

an elongated rear support assembly having a top end, a bottom end, a front wall, a rear wall, first and second side walls, and a bottom wall, said sidewalls of said rear support assembly each comprising two sections, said sections being pivotally attached to each other and to the adjacent front and rear walls of said rear support assembly, and being dimensioned to fold inwardly between said walls, said bottom wall being pivotally attached to the bottom end of either said front wall or said rear wall of said rear support assembly, said sidewall sections and said bottom wall forming, in conjunction with said front and rear walls, a collapsible ballot compartment for receiving marked ballots;

said top end of said front support assembly being pivotally attached to said front end of said base assembly;

said top end of said rear support assembly being pivotally attached to said rear end of said base assembly; and said front and rear support assemblies being pivotally positionable generally perpendicularly to said base assembly and being of a suitable length whereby said base assembly is supported in a generally horizontal voting position above an underlying support surface with said ballot receiving compartment positioned to receive marked ballots passing through said slot, said front and rear support assemblies being further pivotally positionable with said ballot compartment collapsed to positions generally parallel to said base assembly to form a compact unit for storage.

21. A collapsible ballot box as defined in claim 20 wherein said ballot compartment includes a divider wall forming first and second subcompartments within said ballot compartment, and said base assembly includes a ballot sorting device for selectively directing ballots passing through said slot to either said first or second subcompartments.

22. A collapsible ballot box as defined in claim 21 wherein said ballot sorting device is responsive to a control effect developed by said ballot tally machine.

23. A collapsible ballot box as defined in claim 21 wherein said front and rear walls of said rear support assembly each include a lockable access door for removing ballots from respective ones of said ballot subcompartments.

24. A collapsible ballot box as defined in claim 20 wherein said base assembly includes a lockable retaining member for preventing removal of said ballot tally machine from said receptacle.

25. A collapsible ballot box as defined in claim 24 wherein said base assembly further includes a pivotally attached cover positionable to prevent access to said ballot tally machine, said cover in its closed position being engaged by and locked closed by said lockable retaining member.

26. A collapsible ballot box as defined in claim 20 wherein said front support assembly includes a rear wall, first and second side walls and a bottom wall forming in conjunction with said front wall of said front support assembly an auxiliary ballot compartment for receiving ballots not processed by said ballot tally machine, and said front wall of said front support assembly includes a slot for depositioning ballots in said auxiliary ballot compartment.

27. A collapsible ballot box as defined in claim 26 wherein said front wall of said front support assembly includes a lockable cover for closing said slot.

28. A collapsible ballot box as defined in claim 22 wherein said front wall of said front support assembly includes a lockable access door for removing ballots from said auxiliary ballot compartment.

29. A collapsible ballot box as defined in claim 20 wherein said rear wall of said rear support assembly includes a lockable access door for removing ballots from said ballot compartment.

30. A collapsible ballot box as defined in claim 20 including a locking member for locking said rear support assembly in said generally perpendicular balloting position.

31. A collapsible ballot box as defined in claim 20 wherein said base assembly includes an interior compartment for receiving at least a portion of said rear support assembly in said collapsed position for storage.

32. A collapsible ballot box as defined in claim 31 wherein generally said entire rear support assembly is received within said base assembly for storage.

33. A collapsible ballot box as defined in claim 32 including means for fastening said front support assembly to said sidewalls of said base assembly to form a single compact unit for storage.

34. A collapsible ballot box as defined in claim 33 including a support member attached at one end of the bottom end of said front support assembly, and at the other end to the bottom end of said rear support assembly, one of said ends being pivotally attached and the other of said ends being detachable.

35. A collapsible ballot box comprising:

an elongated base assembly having a front end, a rear end, first and second side panels and a top surface, said top surface including a receptacle for receiving a ballot tally machine, and a slot for receiving marked ballots, said slot being positioned to receive ballots processed by said machine;

an elongated front support assembly having a top end, a bottom end, a front wall, a rear wall, first and second sidewalls, and a bottom wall forming an auxiliary ballot compartment for receiving ballots not processed by said ballot tally machine;

an elongated rear support assembly having a top end, a bottom end, a front wall, a rear wall, first and second side walls, and a bottom wall, said sidewalls of said rear support assembly each comprising two sections, said sections being pivotally attached to each other and to the adjacent front and rear walls of said rear support assembly, and being dimensioned to fold inwardly between said walls, said bottom wall being pivotally attached to the bottom end of either said front wall or said rear wall of said rear support assembly, said sidewall sections and said bottom wall forming, in conjunction with said front and rear walls, a collapsible ballot compartment for receiving marked ballots;

said top end of said front support assembly being pivotally attached to said front end of said base assembly;

said top end of said rear support assembly being pivotally attached to said rear end of said base assembly; and said front and rear support assemblies being pivotally positionable generally perpendicularly to said base assembly and being of a suitable length whereby said base assembly is supported in a generally horizontal voting position above an underlying support surface with said ballot receiving compartment positioned to receive marked ballots passing through said slot, said front and rear support assemblies being further pivotally positionable with said ballot compartment collapsed to positions generally parallel to said base assembly to form a compact unit for storage.

36. A collapsible ballot box as defined in claim 35 wherein said ballot compartment includes a divider wall forming first and second subcompartments within said ballot compartment, and said base assembly includes a ballot sorting device responsive to a control effect generated by said tally machine for selectively directing ballots passing through said slot to either said first or second subcompartments.

37. A collapsible ballot box as defined in claim 36 wherein said front and rear walls of said rear support assembly each include a lockable access door for removing ballots from respective ones of said ballot subcompartments.

38. A collapsible ballot box as defined in claim 35 wherein said base assembly includes a lockable retaining member for preventing removal of said ballot tally machine from said receptacle.

39. A collapsible ballot box as defined in claim 38 wherein said base assembly further includes a pivotally attached cover positionable to prevent access to said ballot tally machine, said cover in its closed position being engaged by and locked closed by said lockable retaining member.

40. A collapsible ballot box as defined in claim 38 wherein said front wall of said front support assembly includes a slot for depositioning ballots in said auxiliary ballot compartment and an access door for removing ballots from said auxiliary ballot compartment.

41. A collapsible ballot box as defined in claim 38 wherein said rear wall of said rear support assembly includes a lockable access door for removing ballots from said ballot compartment.

42. A collapsible ballot box as defined in claim 35 including a locking member for locking said rear support assembly in said generally perpendicular balloting position.

43. A collapsible ballot box as defined in claim 38 wherein said base assembly includes an interior compartment for receiving said rear support assembly in said collapsed position for storage.

44. A collapsible ballot box as defined in claim 43 including means for fastening said sidewalls of said front support assembly to said sidewalls of said base assembly to form a single compact unit for storage.

45. A collapsible ballot box as defined in claim 35 including a support member attached at one end of the bottom end of said front support assembly, and at the other end to the bottom end of said rear support assembly, one of said ends being pivotally attached and the other of said ends being detachable.

* * * * *